US005098091A

United States Patent [19]

McGivern

[11] Patent Number: 5,098,091

[45] Date of Patent: Mar. 24, 1992

[54] QUICK CONNECT/DISCONNECT BASKETBALL NET SUPPORT

[76] Inventor: Sean P. McGivern, 5527 Pershing, Apt. 22, St. Louis, Mo. 63112

[21] Appl. No.: 621,629

[22] Filed: Dec. 4, 1990

Related U.S. Application Data

[63] Continuation-in-part of Ser. No. 543,028, Jun. 25, 1990, abandoned.

[51] Int. Cl.[5] ..... A63B 63/08

[52] U.S. Cl. ..... 273/1.5 R

[58] Field of Search ..... 273/1.5 R, 1.5 A

[56] References Cited

U.S. PATENT DOCUMENTS

| | | | |
|---|---|---|---|
| 1,544,453 | 6/1925 | Harbison | 273/1.5 R |
| 2,579,312 | 12/1951 | Garvey | 273/1.5 R |
| 4,353,548 | 10/1982 | Mahoney | 273/1.5 R |
| 4,805,903 | 2/1989 | McArdle | 273/1.5 R |
| 4,877,241 | 10/1989 | Kothbard | 273/1.5 R |

*Primary Examiner*—Paul E. Shapiro

*Attorney, Agent, or Firm*—Polster, Lieder, Woodruff & Lucchesi

[57] ABSTRACT

A quick connect/disconnect basketball net support for supporting a basketball net relative to a rim includes a flexible elongated rod capable of being formed into a hoop corresponding to the shape of a basketball rim. The elongated rod is threaded through upper loops of the basketball net and has its opposite free ends provided with quick connect/disconnect means for attachment to one another to provide the hoop formed elongated rod for supporting the basketball net. Attached to the hoop formed elongated rod are a series of circumferentially spaced quick connect/disconnect means in the form of releasable fasteners which releasably attach the hooped form elongated rod and basketball net relative to the basketball rim. On opposite free ends of the hoop formed elongated rod are complementary releasable connectors for quick assembly and disassembly of the hoop formed elongated rod relative to the basketball net. Each circumferentially spaced releasable fastener is attached to a strap element which provides a loop section above the hoop formed elongated rod for receiving the basketball rim while the releasable fasteners are positioned below the hoop formed elongated rod.

13 Claims, 3 Drawing Sheets

QUICK CONNECT/DISCONNECT BASKETBALL NET SUPPORT

CROSS-REFERENCE TO RELATED APPLICATION

This is a continuation-in-part of patent application Ser. No. 07/543,028 filed June 25, 1990 entitled BASKETBALL NET SUPPORT, now abandoned.

BACKGROUND OF THE INVENTION

The typical basketball net assembly commonly used today includes an 18 inch inch inside diameter metal ring or basketball rim which is attached to a basketball backboard. The metal ring is constructed to include 12 metal wire loops on its underside to which the 12 upper loops of a cord basketball net are attached. Since the basketball rim is 10 feet off the ground, it is customary to use a ladder to attach a replacement net. For the normal indoor gymnasium setting, this approach is expected to remain the same.

On the other hand, in many inner city playgrounds, as well as outdoor basketball courts in parks and schools, it is difficult to keep a functioning basketball net in place. This is due primarily to two reasons. First of all, basketball nets are frequently stolen for home or personal use. Secondly, heavy outdoor use results in a shorter life expectancy of the basketball net.

Many players prefer the use of a basketball net because they can see the net move when a successful shot is made. Net movement also avoids any disputes as to whether or not a successful goal has been shot by a player. However, due to the difficulty of installing a typical basketball net assembly, as well as problems associated with theft and short life expectancy as discussed above, many outdoor courts do not have a basketball net.

Several different attempts have been made to develop a portable basketball net assembly. In this connection, reference is made to U.S. Pat. No. 4,834,368 which discloses a portable basketball net with a "Velcro" band attached to the basketball net and U.S. Pat. No. 4,905,995 which discloses a circular collar and flange end that rests on the top of the basketball ring, the circular collar having a basketball net to be attached thereto. Other types of portable basketball net assemblies include U.S. Pat. No. 2,579,312 where the net is integrally molded from a suitable plastic material and includes fastening buttons and slits for attachment of the net to a basketball rim and U.S. Pat. No. 3,204,957 which discloses cooperating male/female snap fasteners for attachment to a basketball net to facilitate assembly to a basketball rim.

While each of the above patents have various advantages, they do not facilitate the installation and replacement of typical cord basketball nets because they require special constructions which make it difficult to use with the typical cord basketball net. Further, they tend to be more complex and therefore more costly than what is needed. As will be seen from the discussion that follows, the present invention discloses a novel and unique basketball net support with many advantages and features not heretofore available in prior art constructions.

SUMMARY OF THE INVENTION

Accordingly, among the several objects and advantages of the present invention include:

The provision of a novel and improved basketball net support which overcomes the aforenoted disadvantages of the prior art;

The provision of the aforementioned basketball net support which is readily adaptable to the typically constructed cord basketball net;

The provision of the aforementioned basketball net support which facilitates assembly and disassembly relative to a basketball rim;

The provision of the aforementioned basketball net which readily permits removal from a worn out net and replacement relative to a new cord basketball net;

The provision of the aforementioned basketball net which is economical, easy to manufacture, ready to use, simple to attach to basketball rims without instructions, and is otherwise well adapted for the intended purposes.

Briefly stated, the basketball net support of the present invention supports a basketball net relative to a basketball rim and includes a flexible elongated rod capable of being formed into a hoop corresponding in shape to the basketball rim. The elongate rod is threaded through upper loops of the basketball net with opposite free ends thereof attached to one another to provide the hoop formed elongated rod for supporting the basketball net relative to the basketball rim. Circumferentially spaced releasable fastening means are also mounted to the hoop formed elongated rod for releasably attaching the hoop formed elongated rod and supported basketball net relative to the basketball rim. Opposite free ends of the elongated rod are provided with complementary releasable connectors for threading or removing the elongated rod from the upper loops of the basketball net. Preferably, the elongated rod comprises a plastic coated cable.

The circumferentially spaced releasable fastening means preferably includes separate strap elements which are attached to the hoop formed elongated rod in circumferentially spaced positions, with each strap element including complementary releasable fasteners attached to opposite ends thereof. Each strap element is attached to the elongated rod to provide a loop section above the hoop formed elongated rod for receiving the basketball rim, while the complementary releasable fasteners are positioned below the hoop formed elongated rod. Preferably, the complementary releasable fasteners attached to each strap element comprise male and female snap fasteners attached to opposite ends of each strap element.

These and other objects and advantages of the present invention will become apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENTS

Figure 1:
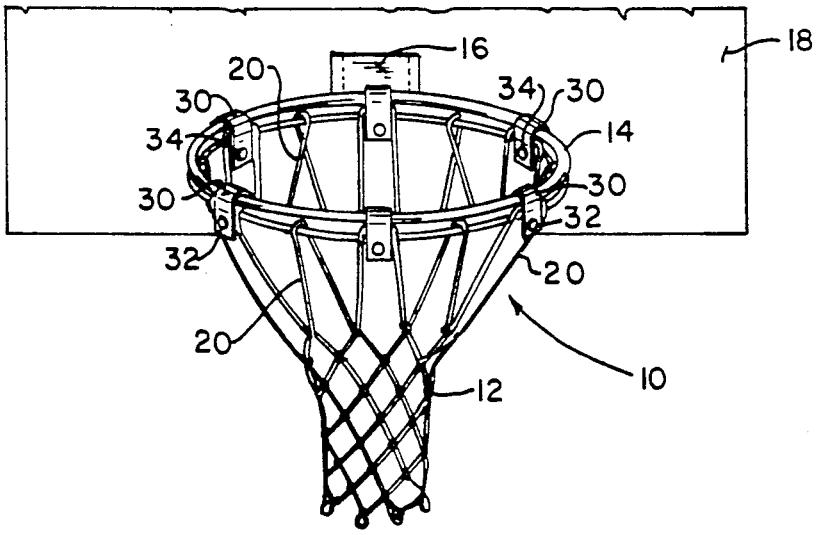
FIG. 1 is a perspective view of one form of basketball net support including a hoop formed elongated rod and releasable fasteners for supporting a basketball net relative to a basketball rim.

The following detailed description illustrates the invention by way of example and not by way of limitation. This description will clearly enable one skilled in the art to make and use the invention and describe several embodiments, adaptions, variations, alternatives and uses of the invention, including what I presently believe is the best mode of carrying out the invention.

There are two embodiments of the invention shown in the drawings, FIGS. 1-6 and FIGS. 7-11.

Reference is first made to embodiment shown in FIGS. 1-6 of the drawings which show the basketball net support generally identified by the numeral 10, for supporting the cord basketball net 12 relative to the basketball rim 14. The basketball rim 14 is supported by the mounting bracket 16 that extends from the basketball backboard 18, as is common.

The cord basketball net 12 is typically provided with 12 upper loops 20 which are provided for assembly relative to 12 wire loops (not shown) that extend from the undersurface of the basketball rim 14, in order to mount the basketball net 12 relative to the basketball rim 14. While indoor basketball facilities will continue to use this method of mounting a cord basketball net to a basketball rim, outdoor basketball facilities require a simpler mounting and installation technique, for the reasons discussed above.

Figure 3:
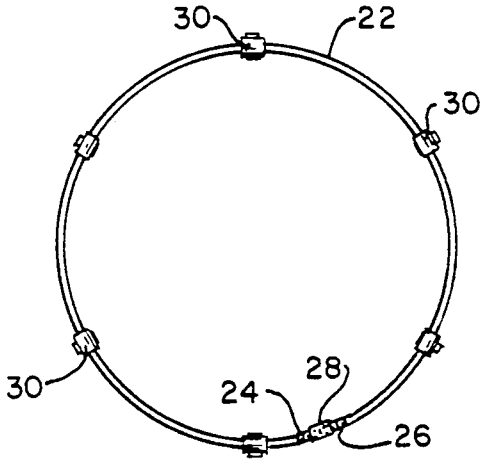
FIG. 3 is a top plan view of the hoop formed elongated rod shown in FIGS. 1-2 with opposite ends thereof releasably connected to one another and including strap elements circumferentially spaced about the hoop formed elongated rod.
Figure 4:
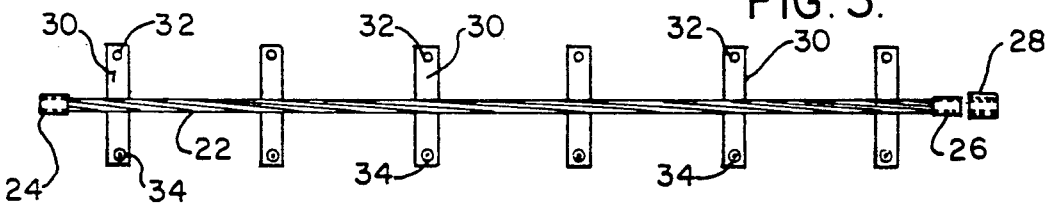
FIG. 4 is a side elevational view of the elongated rod shown in FIG. 3 with circumferentially spaced strap elements prior to being formed into a hoop.

According to the present invention, the basketball net support 10 includes a flexible elongated rod 22, as shown in FIG. 4, which is capable of being formed into a hoop, as shown in FIG. 3, corresponding to the shape of the basketball rim 14. Preferably, the elongated rod 22 is a plastic coated cable, although it is conceivable that other molded plastic constructions, with or without the use of reinforcing elements, could be used as well.

Figure 2:
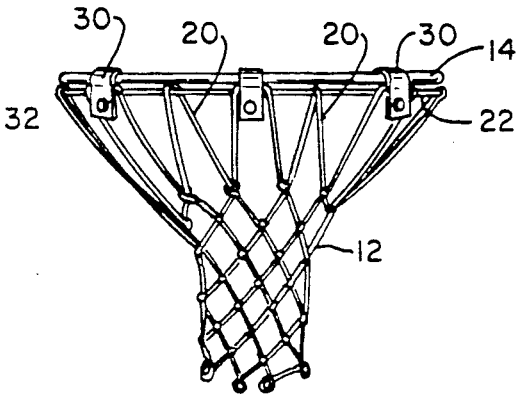
FIG. 2 is a side elevational view of the basketball net support shown in FIG. 1.

As shown in FIGS. 1-2 of the drawings, the flexible hoop formed elongated rod 22 is threaded through the upper loops 20 of the basketball net 12. As mentioned, the hoop formed elongated rod 22, as shown in FIGS. 1-2, corresponds in shape to the basketball rim 14 so as to be positioned in proximate and generally aligned relationship therewith, as is illustrated.

Figure 6:
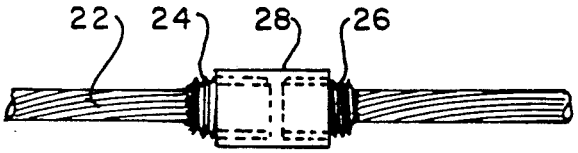
FIG. 6 is a fragmentary side elevational view of the releasable connectors attached to opposite ends of the elongated rod shown in FIGS. 1-5 to facilitate threading or removal of the elongated rod relative to the upper loops of a basketball net.

As best shown in FIGS. 3-4 and 6 of the drawings, quick connect/disconnect means, provided at opposite free ends 24, 26 of the elongated rod 22, are attached to one another to provide the flexible hoop formed elongated rod 22, as shown in FIG. 3 of the drawings. For this purpose, the opposite free ends 24, 26 may be oppositely threaded for complementary threaded engagement with an oppositely internally threaded ferule 28 for threading or removing the hoop formed elongated rod 22 relative to the upper loops 20 of the basketball net 12.

In lieu of the oppositely threaded free ends 24, 26 and oppositely internally threaded ferule 28, other forms of quick connect/disconnect means in the form of complementary releasable connectors may be provided at the opposite free ends of the elongated rod 22, as will be appreciated. Examples of these include interconnecting male/female spring loaded fasteners, push-in/pull-out connectors and other types of complementary releasable connectors, all of which are well known in the prior art. Thus, the use of the oppositely threaded free ends 24, 26 and internally threaded ferule element 28 is representative of one type of complementary releasable connectors for the opposite free ends of the hoop formed elongated rod 22.

In order to attach the hoop formed elongated rod 22 and associated basketball net 12 relative to the basketball rim 14, a series of spaced strap elements 30 are provided along the length of the elongated rod 22, as best shown in FIG. 4 of the drawings. Suitable fastening or attaching means are used for affixing each strap element 30 to the elongated rod 22 in the position shown in FIG. 4 of the drawings. When the elongated rod 22 is formed in its hoop shape as shown in FIG. 3 of the drawings, the strap elements 30 are circumferentially spaced from one another about the hoop formed elongated rod 22, as shown in FIG. 3.

Figure 5:
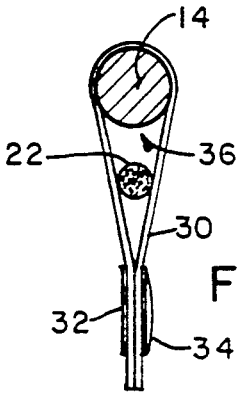
FIG. 5 is a sectional view of the basketball net support of FIGS. 1-4 and illustrating one of the strap elements with complementary releasable fasteners positioned over the basketball rim, and with the elongated rod extending through an upper loop of the basketball net.

Each strap element 30 is provided with quick connect/disconnect fastening means in the form of complementary releasable fasteners for attaching the hoop formed elongated rod 22 to the basketball rim 14. As shown in the drawings, the complementary releasable fasteners comprise male and female snap fasteners 32, 34 which are attached to the opposite ends of each strap element 30, in order to permit quick, easy and reliable mounting of the hoop formed elongated rod 22 and associated basketball net 12 relative to the basketball rim 14, as shown in FIGS. 1-2 and 5 of the drawings. As illustrated, there are 6 strap elements equally spaced from one another about the circumference of the hoop formed elongated rod 22, although it is conceivable that less than that number, for example 4 strap elements, may be all that is necessary to adequately secure the hoop formed elongated rod 22 and associated net 12 relative to the basketball rim 14.

As shown in FIG. 5 of the drawings, each strap element 30 is suitably attached to the flexible elongated rod 22 in order to provide a loop section 36 above the hoop formed elongated rod 22 for receiving the basketball rim 14, while the male and female snap fasteners 32, 34 are positioned below the hoop formed elongated rod 22.

Thus, it is a relatively simple matter for a user to position the strap elements 30 over the basketball rim 14 and snap the male/female fasteners into one another for securely mounting the formed elongated rod 22 and associated basketball net 12 relative to the basketball rim 14. For disassembly, the snap fasteners 32, 34 are uncoupled to permit removal of the basketball net support 10 and associated net 12 from the basketball rim 14.

Referring now to the second embodiment of the invention shown in FIGS. 7-11 of the drawings, it will be seen that the same reference numeral with the suffix "a" added will be used to designate similar parts to the FIGS. 1-6 embodiment.

Figure 7:
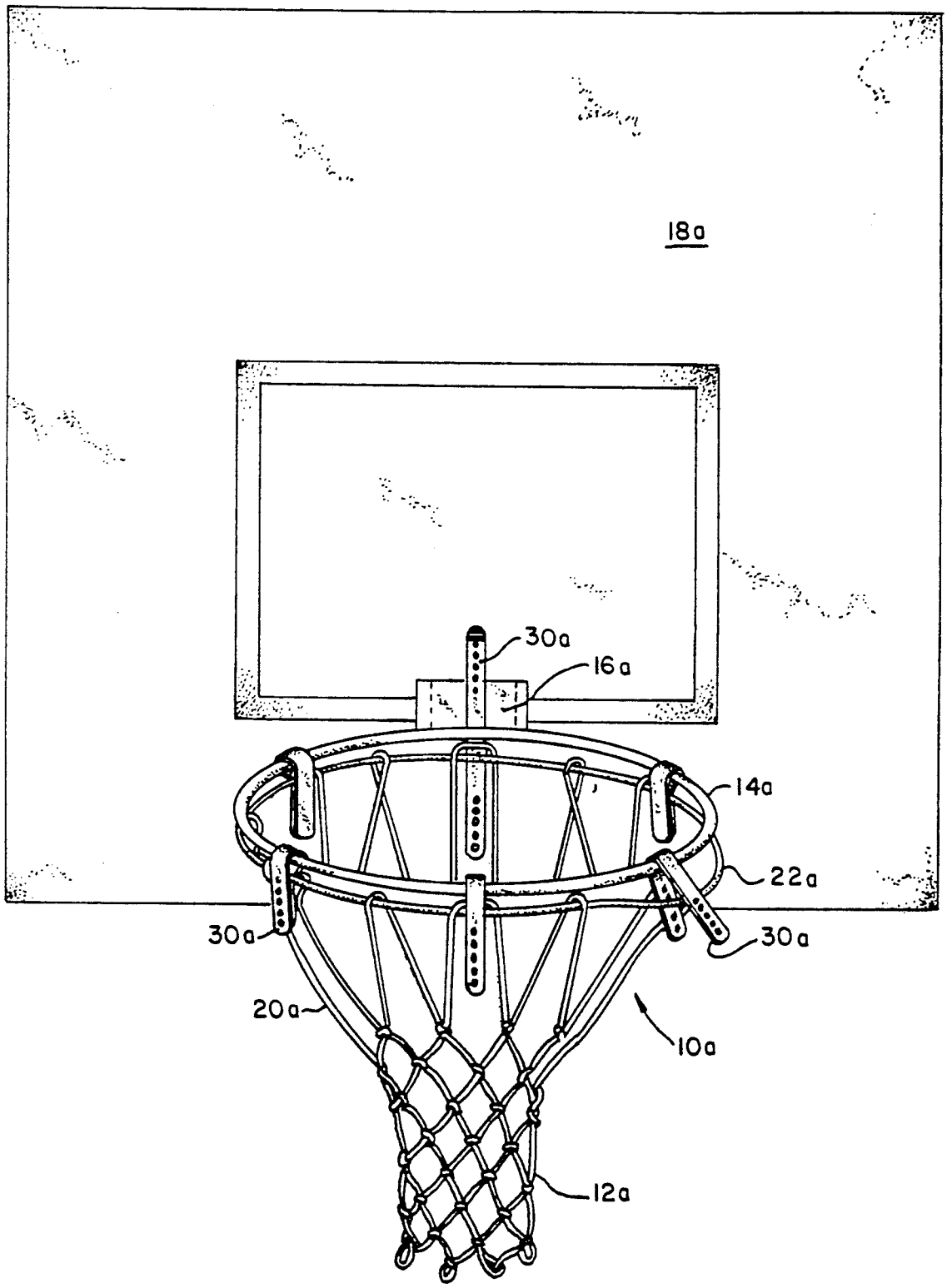
FIG. 7 is an enlarged perspective view of a second form of basketball net support as it is being assembled to a basketball rim.
Figure 8:
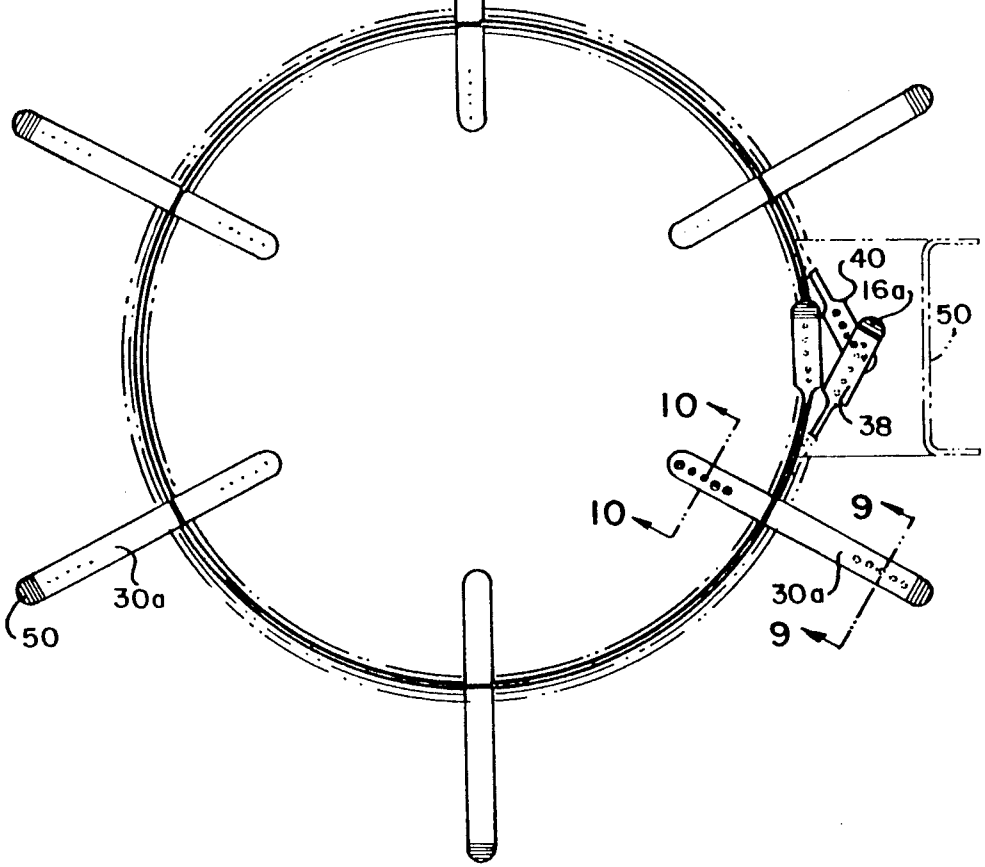
FIG. 8 is a still further enlarged top plan view of the basketball net support shown in FIG. 7.

The basketball net support 10*a* in FIGS. 7-11 includes a one-piece plastic construction including a flexible hoop formed elongated rod 22*a* with integrally molded strap elements 30*a* and integrally molded complementary releasable end connectors 36, 38 formed at the opposite free ends of the flexible hoop formed elongated rod 22*a*, the latter best being seen in FIG. 8 of the drawings.

Figure 11:
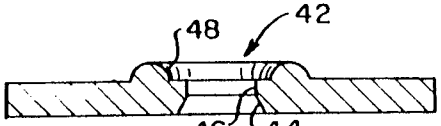
FIG. 11 is a sectional view similar in size to FIG. 10 and showing one of the restrictive apertures of the straps for engaging a respective strap stud, as will be understood.
Figure 10:
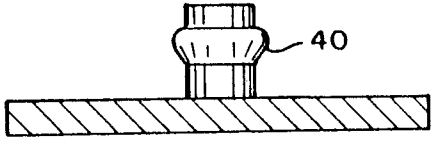
FIG. 10 is a still even further enlarged sectional view of one of the studs of the straps as viewed along lines 9—9 of FIG. 8.

The integrally molded complementary releasable connectors 36, 38 formed at the opposite free ends of the flexible hoop formed elongated rod 22*a* include male and female snap action fasteners, as best shown in FIG. 10-11 of the drawings, to facilitate insertion and releasable engagement, while also permitting disassembly. Thus, the male stud fastener 40 in FIG. 10 is constructed with a enlarged head 41 to be inserted into the female opening 42, first engaging the tapered area 44 for centering purposes, and then expanding the circumferential lip 46 to allow the male stud fastener 40 to expand and pass through the circumferential lip 46 so as to be received in the circumferential depression 48, as is shown in FIG. 11 of the drawings. In this way, a series of studs 40 on one of the releasable connectors 36, 38 can be releasably held in snap-action engagement by a series of female fasteners 42 on the other of the releasable connectors 36, 38, to form the flexible rod 22*a* into the hoop formed elongated rod which passes through the upper loops 20*a* of the basketball net 12*a*, as shown in FIG. 7. A series of snap action fasteners facilitates adjustment while also securing the straps to the rim 14*a*.

Note also in FIG. 8 that the releasable connectors 38, 40 are preferably positioned in the vicinity of the mounting bracket 16*a*, so as to be located out of the way. The releasable connectors 38, 40 are also shown in FIG. 8 in both the unconnected and connected positions, as will be appreciated.

Figure 9:
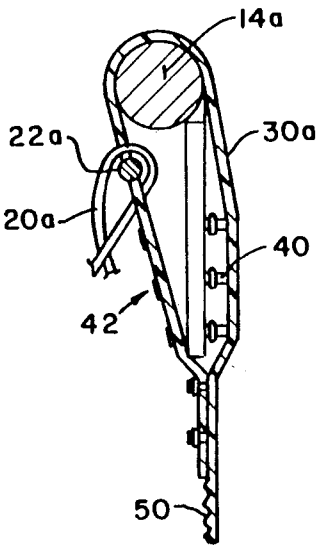
FIG. 9 is an even further enlarged sectional view of one of the straps of the FIG. 7-11 embodiment as it is being secured over a basketball rim.

With respect to each of the straps 30*a*, preferably six in number, complementary male and female snap-action releasable fasteners 40 and 42 are also employed and function in the same manner, as previously described in connection with releasable end connectors 38, 40. As shown in FIG. 9, each strap 30*a* is integrally connected to the flexible hoop formed elongated rod 22*a* and is entrained over the basketball rim 14*a* as illustrated. This enables a series of complementary male and female snap-action releasable fasteners to engage each other, as illustrated, after the flexible hoop formed elongated rod 22*a* is threaded through the upper loops 20*a* of the basketball net 12*a*.

Note also that each strap 30*a* and the releasable end connectors 38 and 40 are provided with an outer knurled surface 50 at one outer free end thereof, to facilitate gripping and manipulating same, for the purposes described.

From the foregoing, it will be appreciated that the novel and unique basketball net support of the present invention provides a quick, easy and reliable method for mounting a basketball net relative to a basketball rim, while also facilitating removal/replacement of the basketball net relative to the basketball net support. Simplicity of operation and use also permits the basketball net support of the present invention to meet consumer needs.

In view of the above, it will be seen that the several objects and features of this invention are achieved and other advantageous results obtained.

As various changes could be made in the above constructions without departing from the scope of the invention, it is intended that all matter contained in the above description or shown in the accompanying drawings shall be interpreted as illustrative and not in a limiting sense.

I claim:

1. A quick connect and disconnect basketball net support for releasably supporting a cord basketball net relative to a basketball rim, comprising:

a flexible elongated rod that is capable of being formed from a linear condition into a hoop corresponding in shape to the basketball rim, said elongated rod being threaded through upper loops of the basketball net and having quick connect/disconnect end connector means at opposite free ends of the elongated rod for attachment to one another to provide the hoop formed elongated rod for supporting the basketball net;

circumferentially spaced quick connect/disconnect fastening means mounted on said hoop formed elongated rod for releasably attaching the hoop formed elongated rod and supported basketball net relative to said basketball rim; and said quick connect/disconnect and connector means being quickly detachable from one another along with the quick detachment of said quick connect-/disconnect fastening means from said basketball rim to facilitate removal and reattachment of said quick connect/disconnect basketball net support to said basketball rim.

2. The basketball net support as defined in claim 1 wherein the elongated rod comprises a plastic coated cable.

3. The basketball net support as defined in claim 1 wherein said circumferentially spaced quick connect-/disconnect fastening means comprise separate strap elements attached to said hoop formed elongated rod in circumferentially spaced positions, each strap element including complementary releasable fasteners attached to opposite ends thereof.

4. The basketball net support as defined in claim 3 wherein each strap element is attached to said elongated rod to provide a loop section above the hoop formed elongated rod for receiving the basketball rim while said complementary releasable fasteners are positioned below the hoop formed elongated rod.

5. The basketball net support as defined in claim 4 wherein said complementary releasable fasteners comprise male and female snap fasteners attached to opposite ends of each strap element.

6. The basketball net support as defined in claim 1 wherein the flexible elongated rod, circumferentially spaced releasable fastening means and quick connect-/disconnect fastening means are integrally molded as a one-piece plastic device.

7. The basketball net support as defined in claim 6 and including complementary male and female snap-action releasable fastening means for both said circumferentially spaced releasable fastening means and said quick connect/disconnect fastening means.

8. The basketball net support as defined in claim 1 wherein said circumferential spaced quick connect/disconnect fastening means comprises a series of complementary male and female snap-action releasable fastening means that are secured to each other relative to said basketball rim.

9. A quick connect/disconnect basketball net support for releasably supporting a cord basketball net relative to a basketball rim, comprising:

a flexible elongated rod capable of being formed from a linear condition into a hoop corresponding in shape to the basketball rim, said elongated rod being threaded through upper loops of the basketball net with opposite free ends of the elongated rod being attached to one another to provide the hoop formed elongated rod for supporting the basketball net;

quick connect/disconnect complementary releasable connector means attached to the opposite free ends of said elongated rod for releasably attaching the elongated rod relative to the upper loops of the basketball net;

circumferentially spaced quick connect/disconnect releasable fastener straps attached to said hoop formed elongated rod for releasably attaching the hoop formed elongated rod and supported basketball net relative to said basketball rim, said strap elements including a loop section above the hoop formed elongated rod for receiving the basketball rim and complementary releasable fasteners positioned below the hoop formed elongated rod; and said quick connect/disconnect complementary releasable connector means being quickly detachable from one another along with the quick detachment of said quick connect/disconnect fastening means from said basketball rim to facilitate removal and reattachment of said quick connect/disconnect basketball net support to said basketball rim.

10. The basketball net support as defined in claim 9 wherein the flexible elongated rod, complementary releasable connectors and circumferentially spaced releasable fastener straps are integrally molded to one another.

11. The basketball net support as defined in claim 10 wherein the complementary releasable connectors and circumferentially spaced releasable fastener straps include male and female snap-action releasable fasteners.

12. In a basketball net support for releasably supporting a cord basketball net relative to a basketball rim, the improvement comprising: a quick connect/disconnect basketball net support including an elongated rod capable of being formed from a linear condition into a hoop corresponding in shape to the basketball rim, said elongated rod being threaded through upper loops of the basketball net and having quick connect/disconnect end connector means at opposite free ends thereof for attachment to one another to provide the hoop formed elongated rod for supporting the basketball net, circumferentially spaced quick connect/disconnect fastening means mounted on said hoop formed elongated rod for releasably attaching the hoop formed elongated rod and supported basketball net relative to said basketball rim; and said quick connect/disconnect end connector means being quickly detachable from one another along with the quick detachment of said quick connect/disconnect fastening means from said basketball rim to facilitate removal and reattachment of said quick connect/disconnect basketball net support from said basketball rim.

13. The improvement as defined in claim 12 wherein each said quick connect/disconnect fastening means comprises a strap element attached to said elongated rod to provide a loop section above the hoop formed elongated rod for receiving the basketball rim while complementary releasable fasteners provided on opposite ends of each strap element are positioned below the hoop formed elongated rod.

* * * * *